US006488367B1

(12) United States Patent
Debesis et al.

(10) Patent No.: US 6,488,367 B1
(45) Date of Patent: Dec. 3, 2002

(54) ELECTROFORMED METAL DIAPHRAGM

(75) Inventors: John R. Debesis, Penfield, NY (US); Yung-Rai R. Lee, Pittsford, NY (US); Edwin A. Mycek, Scottsville, NY (US); Larry L. Lapa, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/524,293

(22) Filed: Mar. 14, 2000

(51) Int. Cl.[7] ..... B41J 2/045
(52) U.S. Cl. ..... 347/70
(58) Field of Search ..... 347/70, 71; 29/890.1, 29/458; 310/338; 205/68

(56) References Cited

U.S. PATENT DOCUMENTS

| | | | | | |
|---|---|---|---|---|---|
| 4,380,018 | A | * | 4/1983 | Andoh et al. | 347/68 |
| 5,375,326 | A | * | 12/1994 | Usui et al. | 29/890.1 |
| 5,424,769 | A | * | 6/1995 | Sakai et al. | 347/70 |
| 5,604,522 | A | * | 2/1997 | Miura et al. | 347/70 |
| 5,764,257 | A | * | 6/1998 | Miyazawa et al. | 347/71 |
| 5,767,612 | A | * | 6/1998 | Takeuchi et al. | 310/314 |
| 6,254,223 | B1 | * | 7/2001 | Kim et al. | 347/70 |
| 6,296,344 | B1 | * | 10/2001 | Sharma et al. | 347/45 |

FOREIGN PATENT DOCUMENTS

| | | | |
|---|---|---|---|
| JP | 52-88549 | | 7/1977 |
| JP | 61-96098 | | 5/1986 |
| JP | 9-27433 | | 1/1997 |
| JP | 410100405 | * | 4/1998 |

* cited by examiner

*Primary Examiner*—John Barlow
*Assistant Examiner*—Michael S Brooke
(74) *Attorney, Agent, or Firm*—Norman Rushefsky; Walter S. Stevens

(57) ABSTRACT

An improved diaphragm (34, 56) for drop on demand ink jet print heads and method for manufacturing the same. The present diaphragm (34, 56) includes a support element (42, 62) defining at least a portion of a chamber (14) for holding ink, the support element (42, 62) defining an opening (40) adjacent to the chamber (14), and the diaphragm (34, 56) being electroformed on a surface (26) of the support element (42, 62) around the opening (40) at least substantially covering the opening (40) and enclosing the chamber (14). The diaphragm (34, 56) preferably has a central region (48) disposed generally centrally over the opening (40) and a bellows (58) surrounds the central region (48). The central region (48) of the electroformed diaphragm (34, 56) is disposed in contact with a piezoelectric transducer (20, 82, 84) for effecting reciprocal movement of the diaphragm (34, 56) for alternately contracting and expanding the volume of the ink holding chamber (14), producing uniform pressure or acoustic waves through ink contained in the chamber (14) whereby ink menisci in nozzles of a print head in communication with the chamber (14) are uniformly oscillated.

22 Claims, 10 Drawing Sheets

ELECTROFORMED METAL DIAPHRAGM

FIELD OF THE INVENTION

This invention relates generally to a diaphragm fabricated on a substrate such as a silicon wafer or the like, and more particularly, to a metal diaphragm electroformed on a silicon wafer, having utility for a drop-on-demand (DOD) ink jet print head, a capacitive pressure sensor, and other applications wherein a metallic, conductive diaphragm can be used.

BACKGROUND OF THE INVENTION

Currently, in micro electronic mechanical systems (MEMS), diaphragms are commonly fabricated from silicon, silicon oxide, silicon nitride and combinations of those materials. Shortcomings of such materials, however, include less than desired robustness compared to diaphragms fabricated from metals such as nickel. A silicon diaphragm also has cleavage planes and can be cleaved under some applications. Additionally, increasing the thickness of a silicon oxide or silicon nitride diaphragm has been found to increase the occurrence of internal stresses in the material, whereas by simply changing the integrated plating current, the thickness of an electroformed nickel diaphragm can be increased without a significant increase in internal stress.

Ink jet printing has become recognized as a prominent contender in the digitally controlled, electronic printing arena because, e.g., of its non-impact, low noise characteristics, its use of plain paper, and its avoidance of toner transfers and fixing. For these reasons, DOD ink jet printers have achieved commercial success for home and office use. DOD ink jet printers typically operate by subjecting a piezoelectric crystal to a high voltage electrical field, causing the crystal to bend, which in turn applies pressure on a reservoir of ink contained in an ink holding chamber of the print head via a flexible diaphragm, for selectably jetting ink drops on demand through an opposing nozzle or orifice. Typically, piezoelectric DOD printers utilize piezoelectric crystals in a push mode, a shear mode, or a squeeze mode. Piezoelectric DOD printers have achieved commercial success at image resolutions up to 720 dpi for home and office printers.

It is desired to fabricate a DOD print head using MEMS techniques which is operable for applying a pressure or acoustic wave to a reservoir of ink for uniformly lifting, raising or otherwise affecting the ink in an array of nozzles or orifices such that the ink can be selectably ejected through the nozzles or orifices using suitable conventional means, such as electrical impulse heaters or the like associated with the individual nozzles or orifices. However, to provide uniform ink ejection across the nozzles or orifices of the array, it has been found that the ink menisci in the respective nozzles or orifices must be uniformly affected by the pressure or acoustic waves.

It is believed that a primary cause of the inability to produce uniform waves is poor diaphragm function. Essentially, when the known diaphragm constructions are deflected or deformed into the ink holding chamber for lifting the ink, the diaphragms bend or bow across the length and width thereof, instead of moving as a unitary element. The bending or bowing of the diaphragm results in a domed structure with maximum deflection at the center, which does not produce a uniform pressure wave across the diaphragm. If a waveform produced in the ink is non-uniform, the ink menisci will be correspondingly non-uniform resulting in non-uniform ink droplet production.

Thus, what is required is a diaphragm for DOD ink jet print heads and other applications which moves or deflects as a unitary element so as to provide uniform pressure or acoustic wave generation characteristics.

SUMMARY OF THE INVENTION

An object of the present invention is to provide an improved diaphragm for DOD ink jet print heads and other applications which moves or deflects essentially as a unitary element so as to produce a more uniform pressure or acoustic wave, for example, in a body of ink in contact therewith to facilitate more uniform ink drop production.

With this object in view, the present invention resides in a diaphragm structure which includes a silicon substrate, such as but not limited to a wafer, having a surface and an opening therethrough, with a metal diaphragm electroformed on the surface and extending over the opening.

More particularly, the present invention resides in an ink jet print head including a support element defining at least a portion of a chamber for holding ink, the support element defining an opening adjacent to the chamber, and a diaphragm electroformed on a surface of the support element around the opening at least substantially covering the opening and enclosing the chamber.

According to an exemplary embodiment of the present invention, the diaphragm has a central region disposed generally centrally over the opening of the support element and a bellows surrounding the central region, the central region preferably being of greater cross sectional extent than the bellows such that the central region is substantially rigid and the bellows flexible. The central region of the electroformed diaphragm is disposed in contact with or connected to a piezoelectric transducer or actuator energizable for effecting reciprocal movement of the diaphragm for alternately contracting and expanding the volume of the ink holding chamber, producing uniform pressure or acoustic waves through ink contained in the chamber whereby ink menisci in nozzles of the print head in communication with the chamber are uniformly oscillated, lifted or otherwise affected.

To facilitate uniform wave generation, the central region of the diaphragm can be thickened relative to the bellows, and/or a stiffening member such as a portion of a silicon wafer mounted or attached thereto. Additionally, the diaphragm can be mounted or affixed to or otherwise brought into contact with the piezoelectric transducer or actuator for oscillating or reciprocating movement therewith. The bellows surrounding the central region of the diaphragm can optionally include one or more elliptical or other shape corrugations to facilitate flexure thereof for uniform displacement of the central region.

The present invention also resides in a method for forming a diaphragm for an ink jet print head, including the steps of electroforming at least one metal layer on a predetermined portion of a first surface of an etchable wafer such as a silicon wafer, etch masking a portion of the second surface of the silicon wafer to define an unmasked portion of the wafer underlying a predetermined portion of the at least one metal layer, and etching through the unmasked portion of the wafer to the at least one metal layer.

A feature of the present invention is the provision of a diaphragm of electroformed metal which is thin yet sufficiently rigid so as to oscillate without substantial deformation thereof, for generating substantially uniform waves in a body of ink or other fluid disposed in contact with one surface of the diaphragm.

Another feature of the present invention is the provision of a unitary diaphragm and surrounding bellows wherein the diaphragm is of greater cross sectional extent than the bellows.

Another feature of the present invention is the provision of an electroformed diaphragm including a stiffening member affixed or mounted thereto.

According to another aspect of the present invention at least one ink inlet channel can be electroformed on the surface of the support element in position for communicating with a source of ink external or internal to the print head. Additionally, the electroformed metal layer forming the diaphragm can include one or more openings or perforations therethrough for filtering ink that flows through the at least one ink inlet channel.

An advantage of the present invention is the ability to move the present diaphragm as a unitary element across substantially the entire length and width thereof for generating substantially uniform waves in a body of ink or other fluid disposed in contact with one surface of the diaphragm.

Another advantage of the present invention is the ability to produce a diaphragm in a manner that can be easily incorporated into conventional manufacturing processes for semi-conductor devices and MEMSs using silicon wafers and the like.

Another advantage of the present invention is the ability to form a unitary diaphragm and bellows wherein the diaphragm is of greater cross-sectional extent than the bellows.

Another advantage of the present invention is the capability to produce a diaphragm and at least one ink inlet channel communicating with a chamber for holding ink using some of the same manufacturing steps.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTIONS OF THE DRAWINGS

While the specification concludes with claims particularly pointing out and distinctly claiming the subject matter of the invention, it is believed the invention will be better understood from the following detailed description when taken in conjunction with the accompanying drawings wherein:

FIG. 1 is a simplified cross-sectional representation of a prior art ink jet print head including a diaphragm shown deformed by a piezoelectric transducer of the print head;

FIG. 2*a* is a simplified cross-sectional representation of a silicon wafer having a strike layer on one surface thereof according to the present invention;

FIG. 2*b* is another simplified sectional representation of the silicon wafer of FIG. 2*a* showing a portion of the strike layer masked to define a diaphragm region having a layer of metal electroformed thereon for producing a diaphragm according to the invention and an etch mask on an opposite surface of the wafer;

FIG. 2*c* is another simplified sectional representation of the silicon wafer of FIGS. 2*a* and 2*b* showing the portion of the wafer underlying the diaphragm and the masks removed;

FIG. 3*a* is a simplified sectional view of another silicon wafer including a strike layer and a pattern dry film resist on one surface thereof defining a bellows and a diaphragm region according to the present invention;

FIG. 3*b* is another sectional view of the silicon wafer of FIG. 3*a* showing the surface of the wafer masked around the bellows and diaphragm region and a metal layer electroformed on the bellows and diaphragm region forming a bellows and diaphragm;

FIG. 3*c* is another sectional view of the silicon wafer of FIGS. 3*a* and 3*b* showing the mask around the bellows and diaphragm removed and an etch mask applied to an opposite surface of the wafer;

FIG. 3*d* is another sectional view of the silicon wafer of FIGS. 3*a* and 3*b* after etching therethrough to the bellows and the diaphragm, and the etch mask and resist removed;

FIG. 3*e* is an alternative sectional view of the silicon wafer of FIGS. 3*a* through 3*c* showing the surface opposite the electroformed layer etch masked to allow etching to the bellows to leave a stiffening member attached to the diaphragm;

FIG. 3*f* is a sectional view of the silicon wafer of FIG. 3*e* after etching and removal of the etch mask;

FIG. 3*g* is an alternative sectional view of the silicon wafer of FIGS. 3*a* through 3*c* showing the bellows masked for electroforming an additional metal layer or layers onto the diaphragm;

FIG. 3*h* is a sectional view of the silicon wafer of FIG. 3*g* after electroforming of the additional metal layer or layers thereon and etching;

FIG. 4*a* is a front view of another silicon wafer including a metal layer electroformed on the front surface therein defining a diaphragm and bellows and elements disposed on an adjacent region of the electroformed layer forming ink flow channels communicating the diaphragm and bellows with a plurality of ink inlet openings through the metal layer according to the present invention;

FIG. 4*b* is a sectional view through the silicon wafer of FIG. 4*a* showing a piezoelectric transducer mounted to the diaphragm and an orifice plate mounted over the diaphragm and the ink flow channels;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
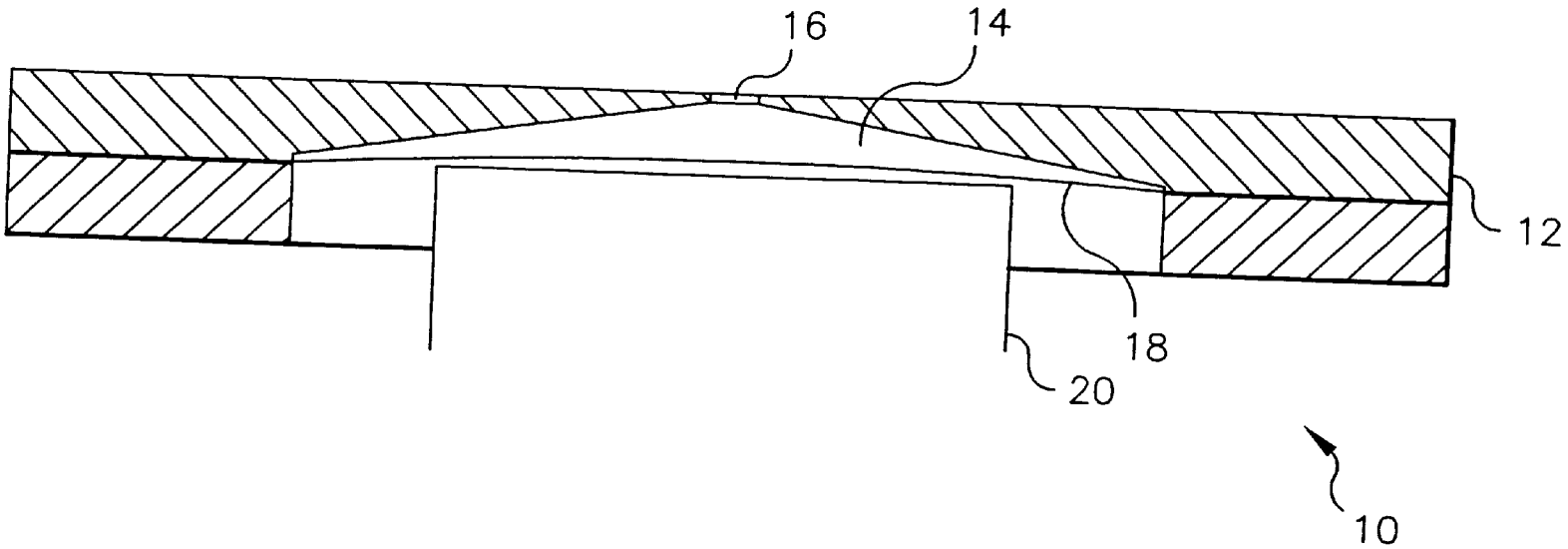
FIG. 1 (PRIOR ART)

Therefore, referring to FIG. 1, there is shown a simplified representation of a typical prior art piezoelectric actuated DOD print head 10. Print head 10 is of laminar construction including a generally planar orifice plate 12 partially defining an ink holding chamber 14 and a plurality of ink ejecting orifices 16 arranged in a linear array communicating with chamber 14 and an orifice 16. Print head 10 includes a diaphragm 18 disposed opposite orifices 16 enclosing ink holding chamber 14. Diaphragm 18 is representative of a wide variety of well known diaphragm constructions including, but not limited to, metallic, silicon and polymeric diaphragm constructions. A conventional piezoelectric transducer 20 is disposed adjacent to diaphragm 18 opposite ink holding chamber 14. Piezoelectric transducer 20 is connected to a source of electrical energy (not shown) in a well known conventional manner and is actuable by the application of an electrical field thereto. When transducer 20 is actuated, diaphragm 18 is alternatingly displaced into ink holding chamber 14 as shown for reducing the interior volume of chamber 14 to effect ejection of ink contained in chamber 14 (not shown) through the orifice 16 in the well known conventional manner.

However, an observed shortcoming of the prior art DOD print heads, as represented by print head 10, is the non-uniform deformation or deflection of diaphragm 18 into ink holding chamber 14, which has been found to generate corresponding non-uniform pressure or acoustic waves through the ink, resulting in irregular or non-uniform ink droplet production, as discussed hereinabove. This problem has been observed with a variety of prior known diaphragm constructions, including thin membranes, foils and films of a variety of materials such as metals, silicons, polymers and the like.

In order to overcome the problem of non-uniform wave generation, the present invention resides in a very thin metal diaphragm electroformed directly onto a surface of a rigid support element such as, but not limited to a silicon wafer, a portion of the material underlying a central portion of the diaphragm being removed, for instance, by etching, such that both opposite surfaces of the diaphragm are exposed, the support element then being laminated or otherwise suitably attached to an orifice plate or an intermediate member in communication with an ink holding chamber of a print head.

Figure 2A:
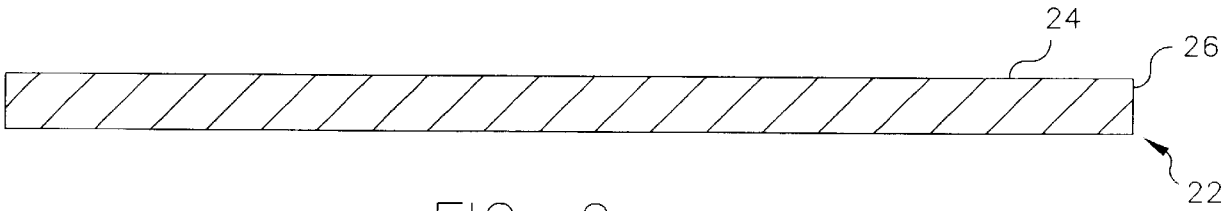

Referring to FIG. 2*a,* a substantially rigid planar silicon wafer 22 is prepared for receiving an electroformed nickel diaphragm according to the present invention. First, a conductive strike layer 24 is placed on a surface 26 of silicone wafer 22. Strike layer 24 should be selected so as to adhere well to surface 26 which may comprise pure silicon or silicone dioxide, and so as to adhere well to the selected metal to be electroformed thereover. The strike layer consists of a vacuum deposited subbing layer of chrome, nickel, titanium or other refractory at a thickness of between about 2.5 and about 50 nm, for instance, about 25 nm is satisfactory. A thicker layer of metal such as nickel is then deposited on top of the subbing layer by physical vapor deposition to produce a layer having a thickness of from about 0.1 to about 0.2 microns. If the film is deposited without a significant amount of internal stress, a thicker layer can be used. The subbing layer serves as an adhesion promoting layer commonly used in thin film technology.

Figure 2B:
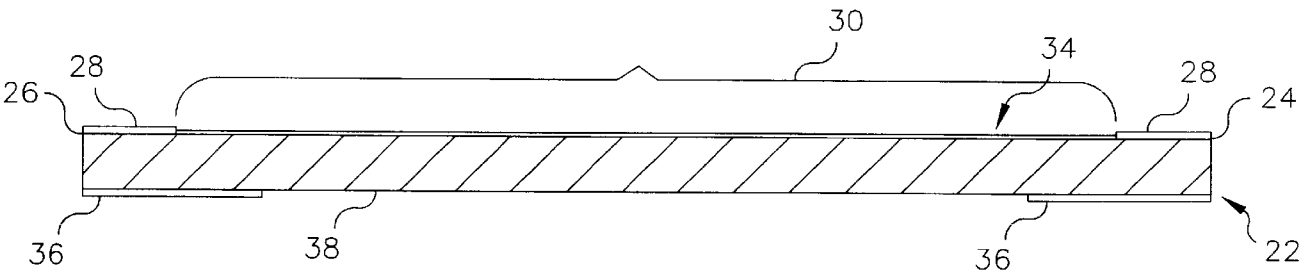

Referring to FIG. 2*b,* a relatively thick (from about 12.5 to about 75 microns) layer of a dry film photoresist 28 is patterned on strike layer 24 defining a diaphragm region 30. A metal layer is then electroformed onto the diaphragm region 30 to form a diaphragm 34. Diaphragm 34 can be electroformed from any metal which provides the desired operational characteristics, such as, but not limited to, nickel. Diaphragm 30 preferably has a thickness of from a few microns to a few tens of microns. An etched mask 36 is then pattern on a surface 38 of silicon wafer 22 opposite surface 26 to define an unmasked region corresponding to a selected portion of diaphragm region 30. The unmasked portion of surface 38 is then subjected a conventional etching operable for etching silicon wafer 22 until the silicon is removed sufficiently to expose diaphragm 34. Here, a reason for selecting nickel as the metal for diaphragm 34 becomes apparent, as nickel serves as an etch stop for a variety of etches including alkaline chemical etches such as potassium hydroxide (KOH) based etches, florine based inductively coupled plasma (ICP) etches, and reactive ion etches (RIE). The thickness of diaphragm 34 can be accurately controlled as is well known in the art by controlling plating current and plating time, plating time being the preferred manner of control.

Figure 2C:
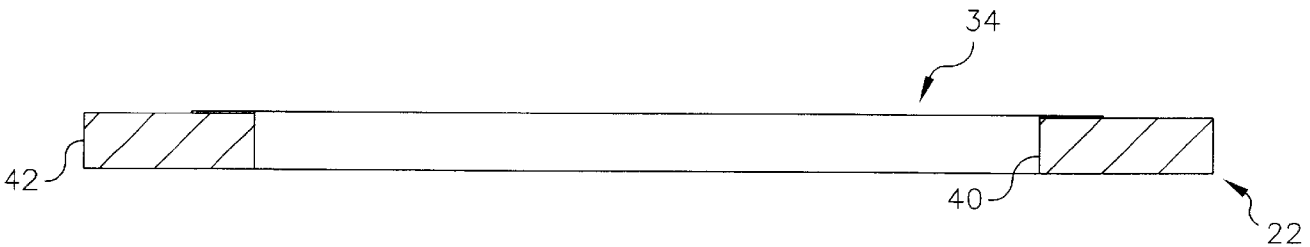

Referring to FIG. 2*c,* after photoresist layer 28 and etch mask 36 are removed, diaphragm 34 is disposed in covering relation to an opening 40 etched through wafer 22, the remaining portion of wafer 22 surrounding opening 40 providing a substantially rigid support element 42 for diaphragm 34. Support element 42 can then be bonded, fastened or otherwise suitably mounted to an orifice plate such as orifice plate 12 (FIG. 1) with diaphragm 34 located in enclosing relation to an ink holding chamber or reservoir such as chamber 14, or to a member disposed between the element 42 and the orifice plate. Additionally, as explained in greater detailed below, one or more inlet channels for the passage of ink from an ink source can be formed on adjacent portion of support element 42, or on the surface of the orifice plate to which support element 42 is to be attached, to provide a pathway for communicating ink to the ink holding chamber or reservoir. Still further, a passage can be etched through support element 42 and holes formed through the metal layer to provide a pathway for communicating with the channels, as will be illustrated hereinafter.

Figure 3A:
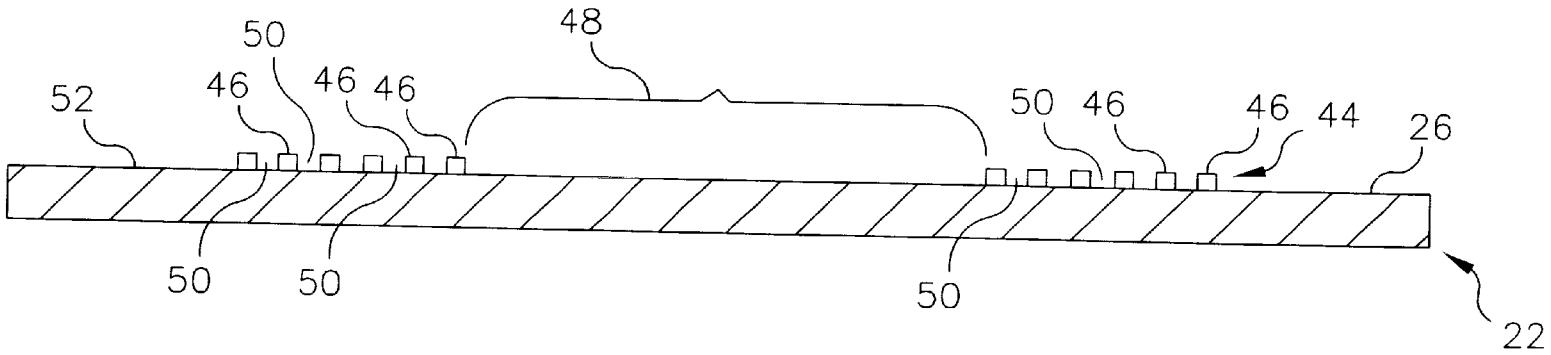

Turning to FIG. 3*a,* a method for forming another embodiment of an electroformed diaphragm according to the present invention will be described. In FIG. 3*a,* a dry film or liquid photoresist layer 44 is applied to a surface 26 of a silicon wafer 22. Photoresist layer 44 consist of a plurality of concentric, progressively larger band shaped elements 46 extending around and defining a central diaphragm region 48 on silicon wafer 22, successive elements 46 being separated by spaces 50. Patterned photoresist layer 44 is then heated so as to harden. When heated, the comers of band shaped elements 46 soften and reflow so as to decrease in sharpness, which is desirable as will be explained. A strike layer 52 is applied to surface 26 over band shaped elements 46 of photoresist layer 44. Strike layer 52 can be similar to the strike layer described above. The preferred method of deposition is physical sputtering, which has been found to provide better sidewall coverage than thermal evaporation. Alternatively, layer 52 can be applied to surface 26 before band shaped elements 46 are applied.

Figure 3B:
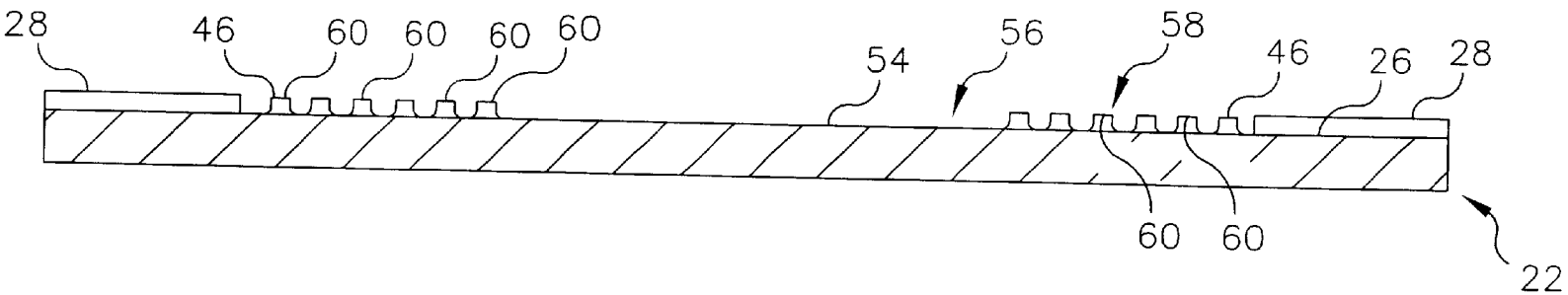

Turning to FIG. 3*b,* a photoresist layer 28 is then applied to surface 26 in a pattern extending around the outermost band shaped element 46 and a metal layer 54 of nickel or another suitable metal, is electroformed onto central diaphragm region 48, band shaped elements 46 and spaces 50 therebetween, thereby forming a diaphragm 56 on central diaphragm region 48 and bellows 58 extending around diaphragm 56. Bellows 58 includes a plurality of concentric elliptical cross-section corrugations 60, defined by band shaped elements 46 and spaces 50 (FIG. 3*a*), the rounded comers of band shaped elements 46 contributing to the elliptical shape.

Figure 3C:
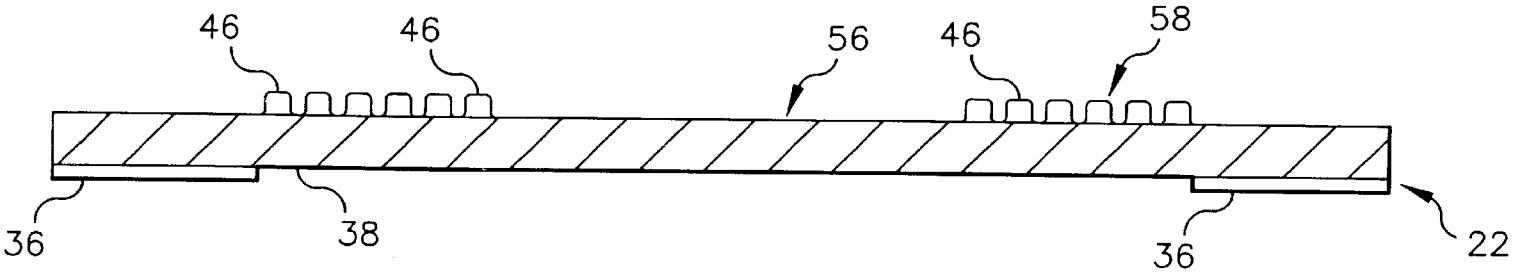

Turning to FIG. 3*c,* an etch mask 36 is applied to opposite surface 38 of silicon wafer 22 in a pattern so as to define an unmasked region opposite diaphragm 56 and bellows 58 which is then etched by using a plasma or chemical etch, as explained above, through to diaphragm 56 and bellows 58, the metal thereof acting as an etch stop. The etch mask 36 and photoresist material of band shape elements 46 are then removed singularly or jointly, for instance, using suitable conventional resist stripping steps.

As another step, the strike layer 52, particularly when not patterned by photoresist layer 44, can be removed as required using a light etch. Since diaphragm 56 is much thicker than layer 52, it is not significantly affected by the light etch.

Figure 3D:
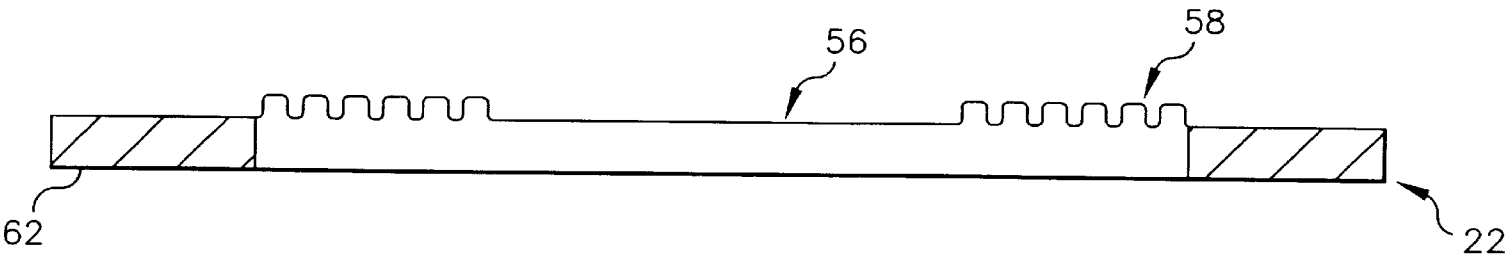

FIG. 3*d* shows the now complete diaphragm 56 and surrounding bellows 58, the remaining portion of silicon wafer 22 extending therearound providing a support element 62.

Figure 3E:
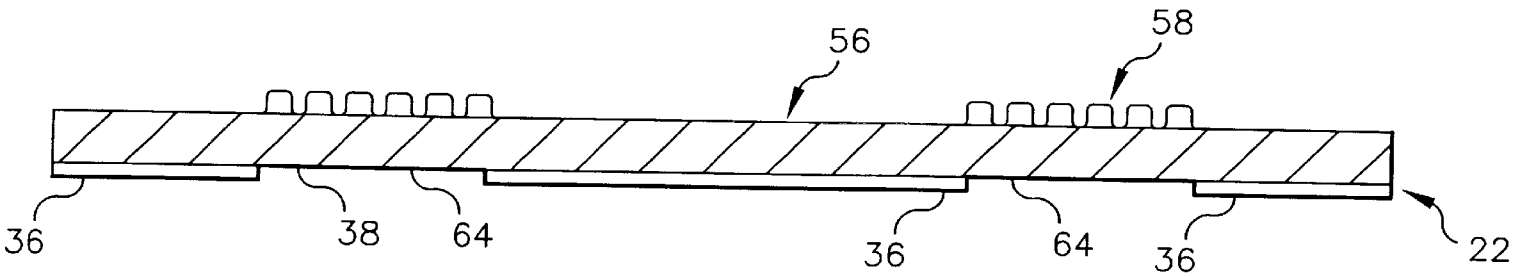
Figure 3F:
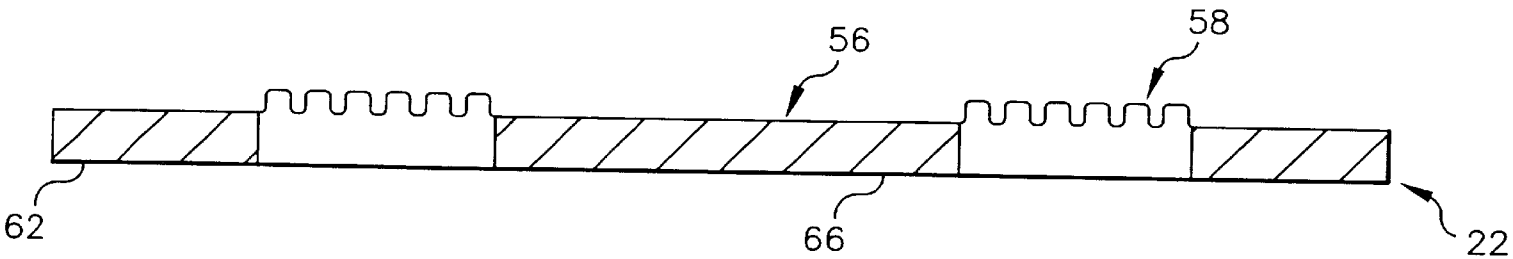

Turning to FIGS. 3*e* and 3*f,* electroformed diaphragm 56 or diaphragm 34 can be provided with a stiffening member or element for increasing the rigidity thereof. To illustrate using diaphragm 56, the diaphragm 56 is electroformed as explained above. However, instead of etching away that portion of the silicon wafer underlying the central region of the diaphragm 56, the portion underlying the central region is masked with etch mask 36 leaving a band shaped unmasked region 64 of surface 38 opposite a circumferential or peripheral portion of diaphragm 56 (here shown opposite bellows 58), as shown in FIG. 3*e.* Then, when silicon wafer 22 is etched, only that portion of silicon wafer 22 exposed by unmasked region 64 is removed, leaving support element 62 around bellows 58 and a stiffening member 66 attached to diaphragm 56.

Figure 3G:
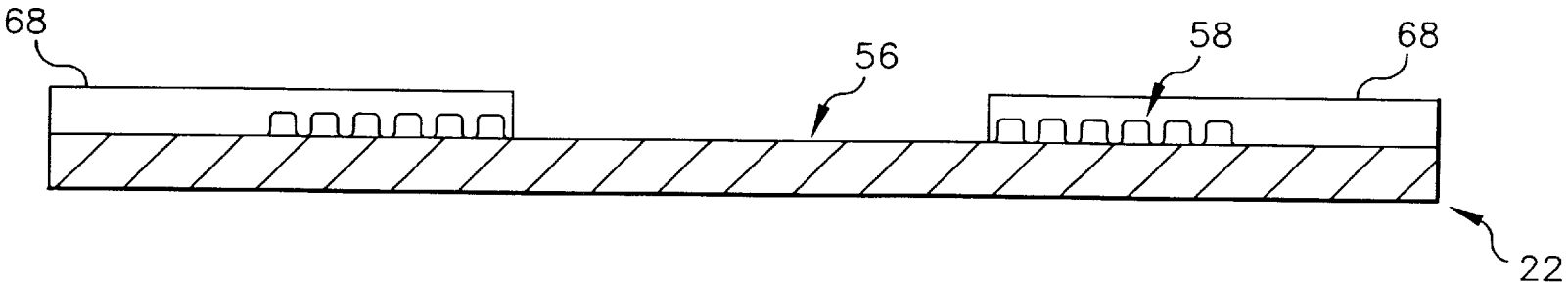
Figure 3H:
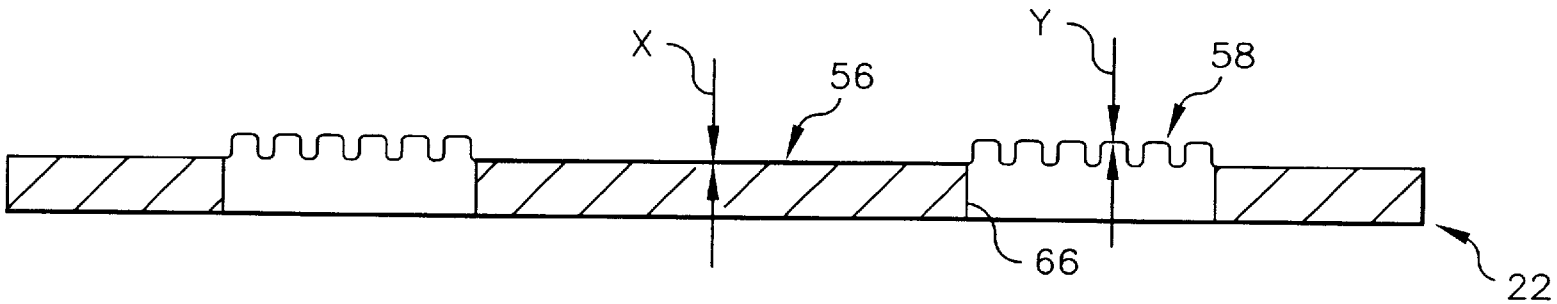

Referring to FIGS. 3*g* and 3*h,* diaphragm 56 can be further or alternatively stiffened before or after the initial electroforming thereof, by masking bellows 58 with a photoresist layer 68, then electroforming additional metal onto bellows 56 in the above-described manner, such that diaphragm 56 has a greater cross sectional extent as denoted at X in FIG. 3*h* than the cross sectional extent of bellows 58, as denoted at Y. Here, thicker diaphragm 56 is shown in association with stiffening member 66, it being likewise contemplated that the thicker diaphragm being usable without the stiffening member, as desired.

Figure 4A:
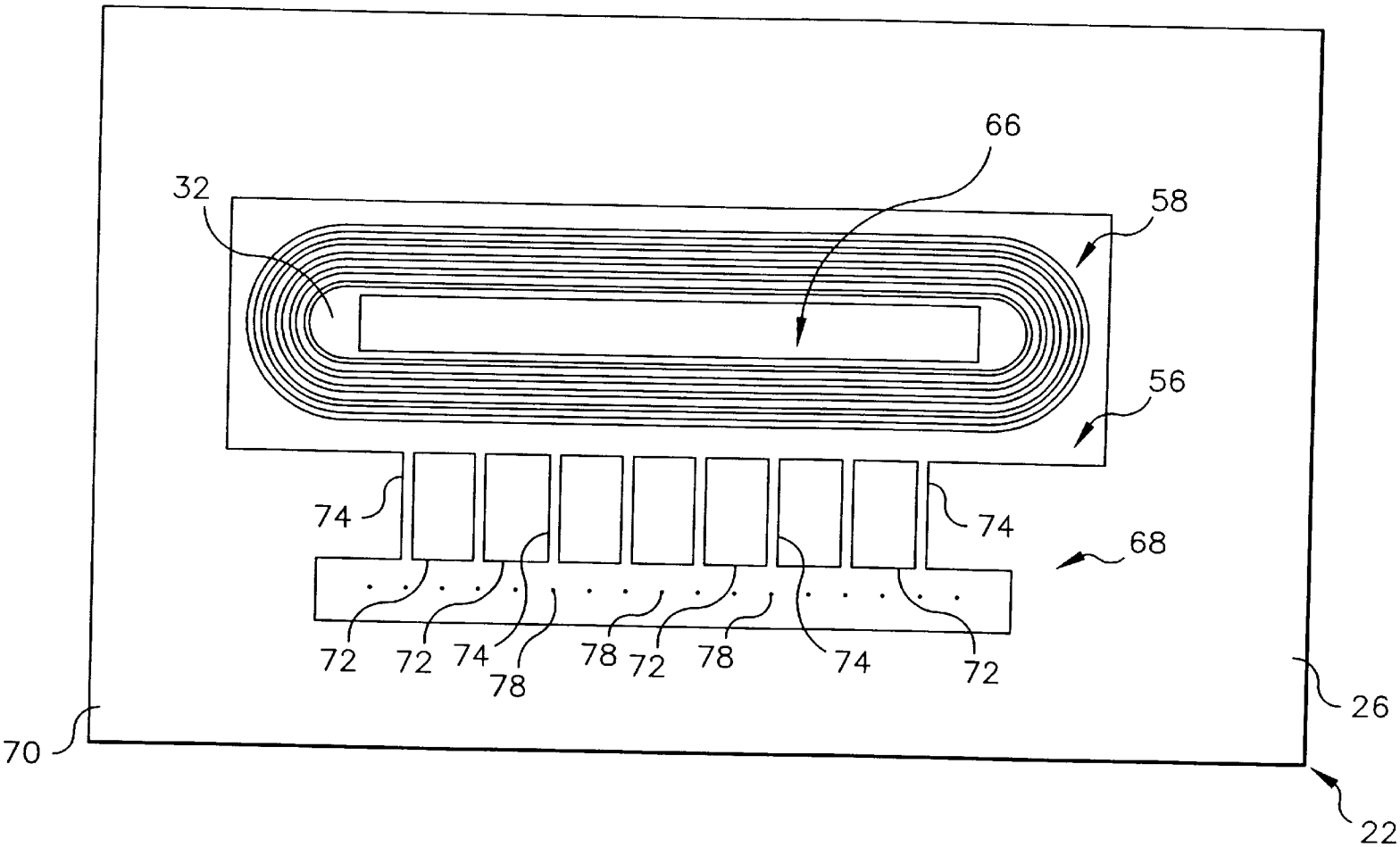
Figure 8:
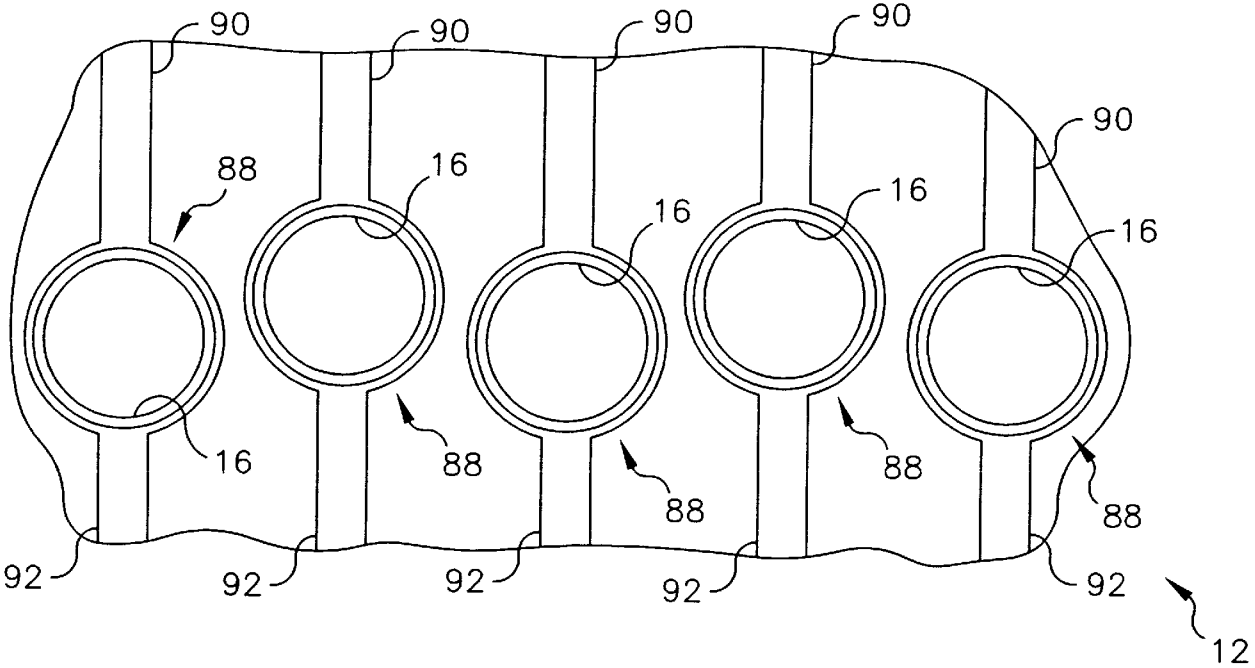
FIG. 8 is an enlarged front view of an orifice plate including a closely spaced, offset array of ink ejecting orifices according to the present invention.

Referring to FIG. 4*a,* another silicon wafer 22 includes a front surface 26 having a metal layer 32 electroformed thereon to form a diaphragm 56 and a bellows 58 in the above described manner. Metal layer 32 covers an adjacent portion 68 of front surface 26, and elements 70 and 72 are disposed on metal layer 32 defining a plurality of ink inlet or flow channels 74 communicating an ink inlet region 76 with diaphragm 56 and bellows 58. Ink inlet region 76 of metal layer 32 includes a plurality of ink inlet openings 78 therethrough communicating with an ink passage 80 (FIG. 4*b*) extending through wafer 22 and adapted for connection in fluid communication with a source of ink (not shown). Alternatively, a single ink inlet opening could be provided, the size of the ink inlet opening or openings being determinable based on the ink flow requirements of a particular application. Elements 70 and 72 can be formed of any suitable material so as to extend above metal layer 32 by an extent sufficient to form ink inlet channels 74 of desired size. For instance, elements 70 and 72 can be formed of metal electroformed onto metal layer 32 in a suitable pattern, a polyimide film layer, or the like. Diaphragm 56 is shown including a stiffening member 66 optionally affixed or mounted thereto. Stiffening member 66 can be composed of any desired material, such as, but not limited to, nickel or silicon, as discussed above. Bellows 58 is shown having an elongate or generally elliptical or oval shape with rounded ends. Such a shape facilitates use in association with a longitudinal array of ink ejecting orifices, such as illustrated in FIGS. 5 and 8, it being contemplated that that a wide variety of other shapes could be used, for instance a rounded or circular shape, as required or desired for use with a particular orifice or array of orifices. The opening over which diaphragm 56 is mounted can have a rectangular or corresponding rounded shape, as desired, a shape such as an ellipse or oval being preferably formed in silicon by dry etching with an ICP source.

Figure 4B:
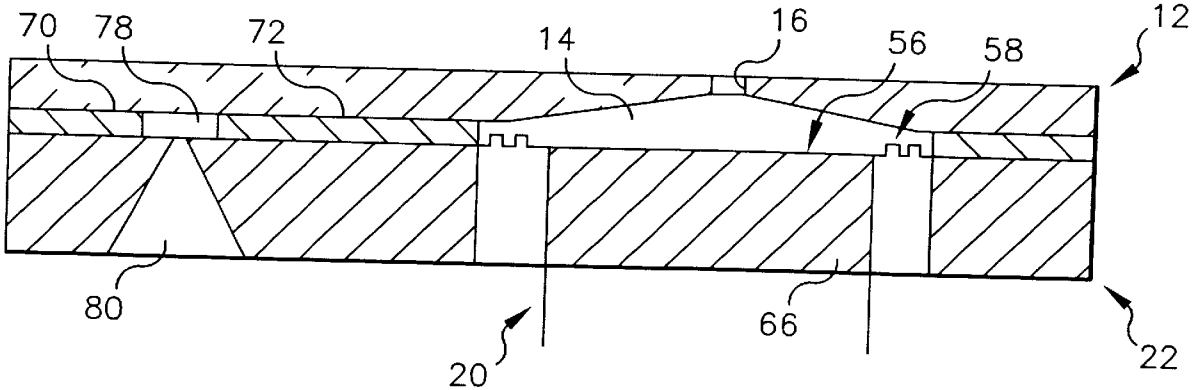
Figure 5:
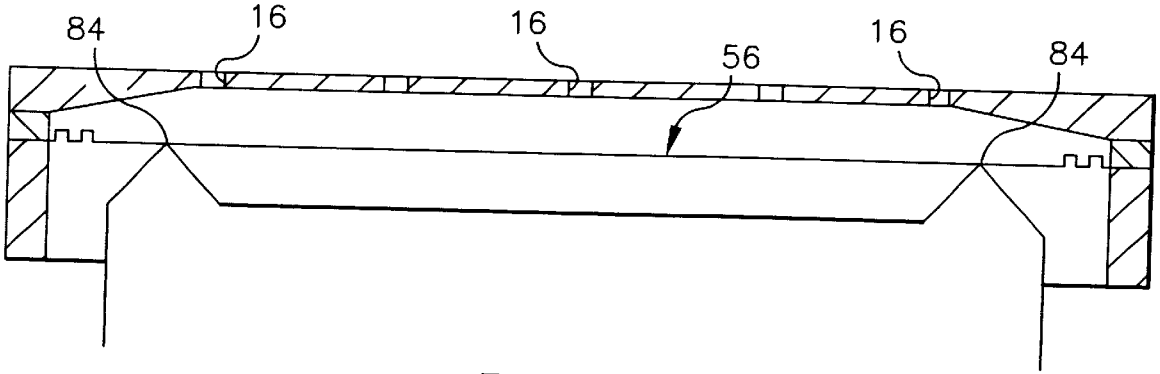
FIG. 5 is a sectional view of a print head constructed according to the present invention including an alternative piezoelectric transducer embodiment associated therewith.

Turning to FIG. 4*b,* silicon wafer 22 is shown including an orifice plate 12 mounted thereon over elements 70 and 72, forming an ink holding chamber 14 adjacent to diaphragm 56 and bellows 58, silicon wafer 22 being masked and etched as explained above in reference to FIGS. 3*e* and 3*f* to form a stiffening member 66 attached to diaphragm 56, and wafer 22 being masked and etched in a similar manner to form an ink passage 80 therethrough communicating with ink inlet openings 78. In this regard, ink inlet openings 78 can be relatively small so as to serve to filter ink flow therethrough en route to ink inlet region 76. Additionally, a piezoelectric transducer 20 is shown attached or mounted to stiffening member 66 for displacing or deflecting diaphragm 56 to effect ejection of ink contained in chamber 14 through orifices 16 of orifice plate 12 in the above described manner.

FIG. 5 shows a diaphragm 56 constructed in the above described manner including a stiffening member 66 attached thereto, and an alternative piezoelectric transducer 82, transducer 82 including longitudinally spaced points 84 attached to or in contact with stiffening member 66. Piezoelectric transducer 82 can be mounted so as to be adjustably rotatable in a plane parallel to the array of orifices 16 of a print head with which diaphragm 56 is used, to allow tuning the displacement or deflection of diaphragm 56 so as to be more closely uniform from end to end.

Figure 6:
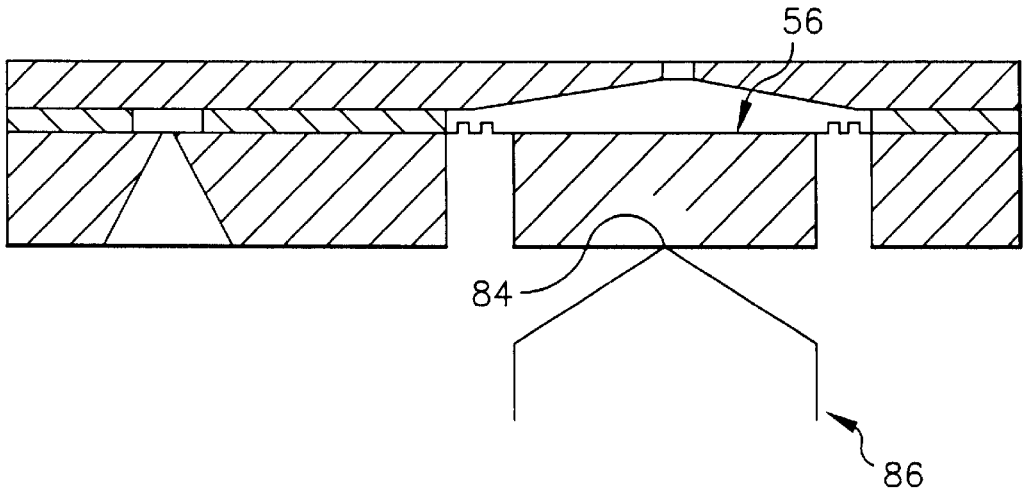
FIG. 6 is a sectional view through a print head according to the present invention showing still another embodiment of a piezoelectric transducer in association therewith.

FIG. 6 shows reinforced diaphragm 56 having yet another alternative piezoelectric transducer 86 in contact with or mounted to stiffening member 66 thereof, transducer 86 having just one point 84 contacting stiffening member 66 at the center thereof to provide uniform displacement of the diaphragm 56 and stiffening member 66.

Here, in the instance of piezoelectric transducers 82 and 86, points 84 can be formed of the piezoelectric material itself, or from a separate material attached to the piezoelectric material, as desired. Here it should be additionally understood that the thickness of diaphragm 56 and diaphragm 34 as well as stiffening member 66 can be varied to allow altering or adjusting the resonant frequency of the diaphragm or diaphragm assembly to provide a frequency to give the best performance.

Figure 7:
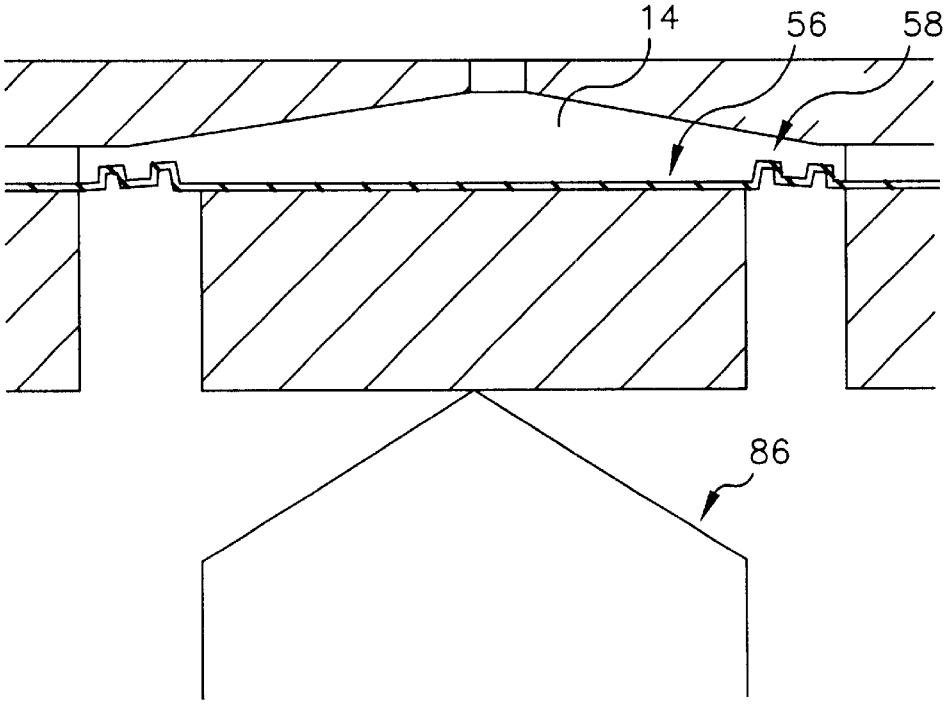
FIG. 7 is another sectional view of the print head of FIG. 6 showing deflection of the diaphragm thereof by the piezoelectric transducer.

To illustrate an advantage of the present invention, FIG. 7 shows deflection or displacement of diaphragm 56 of the present invention by piezoelectric transducer 86, diaphragm 56 remaining substantially planar while bellows 58 is flexed, so as to produce uniform pressure waves throughout ink contained in ink holding chamber 14 and ink menisci in nozzles 16, as desired.

To illustrate another advantage of the present invention, FIG. 8 shows a segment of a front surface of an alternative orifice plate 12 constructed according to the invention including a plurality of orifices 16 arranged in a closely spaced offset array, each orifice 16 including an electrical impulse heater 88 therearound adapted for connection in electrical communication with a source of electrical energy through a control device (both not shown) by conductive paths 90 and 92. Diaphragms constructed according to the teachings of the present invention such as diaphragms 34 and 56 described hereinabove, facilitate the placement of orifices in closely spaced arrangements such as, but not limited to, that shown, such that a relatively large number of orifices can be provided in a small space.

Figure 9:
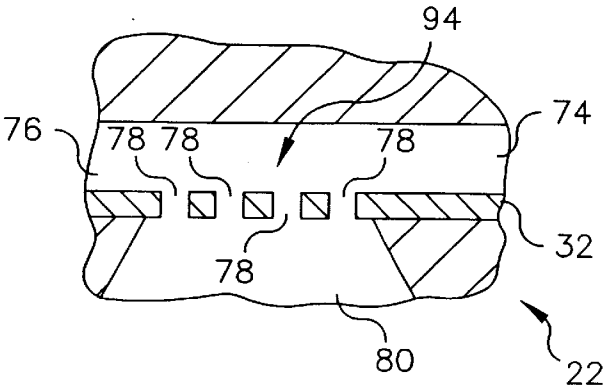
FIG. 9 is a fragmentary sectional view of the silicon wafer of FIG. 4*a,* including a plurality of ink inlet openings through the metal layer forming a filter according to the present invention.

To illustrate another advantage of the present invention, FIG. 9 shows a silicon wafer 22 constructed similarly to that of FIG. 4*b,* including a plurality of ink inlet openings 78 etched through metal layer 32 communicating ink inlet region 76 and a ink inlet channel 74 with ink passage 80, forming a filter 94. Openings 78 of filter 94 are large enough to allow a desired flow rate of ink to pass into region 76 but small enough to trap particulates that can clog the ink ejecting orifices. Filter 94 can also serve as a fluidic resistive element. That is, the grid-like pattern of openings 78 can regulate or resist ink flow into region 76, thereby increasing the efficiency of the pumping of ink into the ink holding chamber. Here, it should be notified that the number and/or the size of openings 78 can be varied to achieve a desired balance of filtration and fluidic resistance. For instance, opening 78 about the same size as the ink ejecting orifices have been found satisfactory.

To illustrate a further advantage of the present invention, it should be apparent from the description hereinabove that the diaphragms and ink flow channels according to the invention can be produced using standard CMOS manufacturing techniques and apparatus.

Therefore, what is provided is several diaphragm structures and methods of manufacture thereof, operable for producing uniform acoustic or pressure waves through a body of ink in a DOD print head The foregoing describes a number of preferred embodiments of the present invention. Modifications, obvious to those skilled in the art, can be made thereto without departing from the scope of the invention.

Parts Lists

10 print head
12 orifice plate
14 ink holding chamber
16 ink ejecting orifice
18 diaphragm
20 piezoelectric transducer
22 silicon wafer
24 strike layer
26 surface
28 photoresist layer
30 diaphragm region
32 metal layer
34 diaphragm
36 etch mask
38 surface
40 opening
42 support element
44 photoresist layer
46 band shaped element
48 central diaphragm region
50 space
52 strike layer
54 metal layer
56 diaphragm
58 bellows
60 corrugation
62 support element
64 unmasked region
66 stiffening member
68 adjacent portion
70 element
72 element
74 ink inlet channel
76 ink inlet region
78 ink inlet opening
80 ink passage
82 piezoelectric transducer
84 point
86 piezoelectric transducer
88 electrical impulse heater
90 conductive path
92 conductive path
94 filter

What is claimed is:

1. An inkjet print head, comprising;

a support element defining at least a portion of a chamber for holding ink, the support element defining an opening adjacent to the chamber, and a diaphragm electroformed on a surface of the support element at least substantially covering the opening and enclosing the chamber, wherein the diaphragm comprises a central region portion disposed generally centrally over the opening and a bellows portion surrounding the central region portion, the bellows portion and the central region portion being both electroformed and wherein the bellows portion comprises at least one corrugation of oval configuration.

2. The ink jet print head of claim 1, wherein the diaphragm has a first surface in communication with the chamber for holding ink, an opposite second surface, and a cross sectional extent as measured between the first surface and the second surface, the cross sectional extent of the central portion of the diaphragm being greater than the cross sectional extent of the bellows portion.

3. The ink jet print head of claim 1, wherein the central region portion of the diaphragm includes a stiffening member mounted thereto.

4. The ink jet print head of claim 1, wherein the diaphragm comprises at least one electroformed metal layer comprised of nickel.

5. The ink jet print head of claim 1, further comprising a structure electroformed on the surface of the support element defining at least one ink inlet channel communicating with the chamber for holding ink.

6. The ink jet print head of claim 5, further comprising a filter for filtering ink that passes through the at least one ink channel.

7. The ink jet print head of claim 1 wherein the support element comprises a silicon wafer.

8. The ink jet print head of claim 1 and wherein the central region portion is disposed in contact with or connected to a piezo electric transducer or actuator that is energizable for effecting reciprocal movement of the diaphragm for alternately contracting and expanding the volume of the ink holding chamber.

9. The inkjet printhead of claim 8 and wherein the central region portion is thicker than the bellows portion.

10. The ink jet print head of claim 8 and wherein the diaphragm is formed on a silicon wafer.

11. The ink jet print head of claim 8 and wherein the ink jet print head is a drop on demand inkjet print head wherein the diaphragm provides a pressure or acoustic wave to the reservoir of the ink for affecting the ink in an array of nozzles.

12. An inkjet print head, comprising;

an orifice plate having a front surface, an opposite back surface at least partially defining an ink holding chamber, and a plurality of ink ejecting orifices extending therethrough between the front surface and the ink holding chamber; and a diaphragm support element having a first surface laminated to the orifice plate and an etched portion defining an opening through the support element in alignment with the ink holding chamber, the first surface having a metal diaphragm electroformed thereon and extending over the opening enclosing the ink holding chamber, wherein the diaphragm comprises a central region portion disposed generally centrally over the opening and a bellows portion surrounding the central region, and the bellows portion and the central region portion being both electroformed and wherein the bellows portion comprises at least one corrugation of oval configuration.

13. The ink jet print head of claim 12, wherein the central region of the diaphragm includes a stiffening member mounted thereto.

14. The ink jet print head of claim 12, further comprising a structure electroformed on the surface of the support element defining at least one ink inlet channel communicating with the ink holding chamber.

15. The ink jet print head of claim 14, further comprising an array of openings for filtering ink passing into the ink channel.

16. The ink jet print head of claim 12, wherein the orifice plate and the support element comprise silicon wafers.

17. The inkjet print head of claim 12, wherein the central region portion of the diaphragm includes a stiffening member mounted thereto.

18. For use in an inkjet printer a structure, comprising:

a silicon substrate having a surface and an opening therethrough; and a metal diaphragm electroformed to overlie the surface of the silicon substrate and extending over the opening, wherein the metal diaphragm comprises a central region portion disposed generally centrally over the opening and a bellows portion surrounding the central region portion, and the bellows portion and the central region portion being both electroformed and wherein the bellows portion comprises at least one corrugation of oval configuration.

19. The diaphragm structure of claim 18, wherein the metal comprises nickel.

20. The diaphragm structure of claim 19, wherein the central region of the diaphragm includes a stiffening member mounted thereto.

21. The diaphragm structure of claim 20, wherein the stiffening member comprises a silicon member.

22. The diaphragm structure of claim 18, wherein the metal diaphragm comprises a central region having a stiffening member attached thereto.

* * * * *